US005799409A

United States Patent [19]

Chau-Huu et al.

[11] Patent Number: 5,799,409

[45] Date of Patent: Sep. 1, 1998

[54] DEVICE FOR DRYING A MATERIAL WEB WITH HEATED AND COOLED CYLINDERS

[75] Inventors: Tri Chau-Huu; Albrecht Meinecke, both of Heidenheim; Markus Oechsle, Bartholomä, all of Germany

[73] Assignee: Voith Sulzer Papiermaschinen GmbH, Heidenheim, Germany

[21] Appl. No.: 856,185

[22] Filed: May 14, 1997

[30] Foreign Application Priority Data

May 15, 1996 [DE] Germany ..... 196 19 530.6
Oct. 15, 1996 [DE] Germany ..... 296 17 881 U

[51] Int. Cl.[6] ..... D21F 5/00

[52] U.S. Cl. ..... 34/117; 34/119; 34/123; 34/124

[58] Field of Search ..... 34/111, 116, 117, 34/119, 120, 123, 124; 162/206, 207

[56] References Cited

U.S. PATENT DOCUMENTS 3,503,139 3/1970 Mahoney et al. .
3,925,906 12/1975 Chance et al. .
4,461,095 7/1984 Lehtinen ..... 34/116 X
4,622,758 11/1986 Lehtinen et al. ..... 34/116 X
5,291,666 3/1994 Babinsky et al. .
5,572,801 11/1996 Ahokas et al. ..... 34/116 X

FOREIGN PATENT DOCUMENTS 3520070 12/1985 Germany .
3532853 4/1986 Germany .

OTHER PUBLICATIONS

German Search Report. For Application DE 196 19 530 dated Sept. 3, 1996.

*Primary Examiner*—Henry A. Bennett
*Assistant Examiner*—Steve Gravini
*Attorney, Agent, or Firm*—Greenblum & Bernstein P.L.C.

[57] ABSTRACT

Device for producing a material web in a dryer part that includes at least one dryer section having a plurality of cylinders including heated cylinders and cooled cylinders. The device may also include a porous dryer screen and a metal belt that may be guided with the material web in a meandering path alternatingly around the heated and cooled cylinders. At least one of the metal belt and the dryer screen being highly prestressed and the device may also include at least one of a heating installation and a cooling installation assigned to act on an area of a circumference of the plurality of cylinders in which the material web may be supported by the dryer screen and the metal belt.

35 Claims, 4 Drawing Sheets

DEVICE FOR DRYING A MATERIAL WEB WITH HEATED AND COOLED CYLINDERS

CROSS-REFERENCE OF RELATED APPLICATION

The present invention claims the priority under 35 U.S.C. § 119 of German Patent Application No. 196 19530.6 filed on May 15, 1996 and German Application No. 296 17881.0 filed on Oct. 15, 1996, the disclosures of which are expressly incorporated by reference herein in their entireties.

BACKGROUND OF THE INVENTION

1. Field of the Invention

This invention pertains to a device for manufacturing a material web, e.g., a paper or cardboard web, including a dryer section having a plurality of cylinders which, viewed in a direction of web travel, may be alternately heated and cooled. The web may be guided in a meandering or winding path around the plurality of cylinders with a porous dryer screen (or belt) and a metal belt. The material web may be positioned between the porous dryer screen and the metal belt and at least one of the metal belt and the dryer screen may be highly prestressed. Additional heating installations and/or cooling installations may be associated with the plurality of cylinders to act on portions of their respective circumferences on which the web is supported by the porous dryer screen and the metal belt.

2. Discussion of Background Information

Devices of the type generally described above have been discussed, e.g., in U.S. Pat. No. 5,291,666. In the prior art, the material web producing device is provided with a dryer section having at least one dryer part and consists of a number of cylinders which, when viewed in a web movement direction, are alternately heated and cooled. The material web is guided together with, and between, a porous dryer belt or screen and a metal belt, in a meandering path around the cylinders. However, in these arrangements, the drying rates within the dryer section are inadequate, thus, requiring enlarging the dryer sections to ensure satisfactory drying. Another disadvantage of the prior art is that, in certain areas of the dryer section, the material web lies exposed on the conveyor, causing unimpeded shrinkage of the width of the web. This results in the material web exhibiting different web properties across a width of the material web. These property differences reduce the quality of the material web.

SUMMARY OF THE INVENTION

It is, therefore, an object of the present invention to provide a material web producing device which does do suffer from the above-noted deficiencies and disadvantages.

In view of the foregoing, it is the object of the present invention to provide a material web producing device in which the device may include a dryer section having a plurality of cylinders which, viewed in a direction of web travel, may be alternately heated and cooled. The web may be guided in a meandering or winding path around the plurality of cylinders with a porous dryer screen and a metal belt. The material web may be positioned between the porous dryer screen and the metal belt and at least one of the metal belt and the porous dryer screen may be highly prestressed. Additional heating installations and/or cooling installations may be associated with the plurality of cylinders to act on portions of their respective circumferences on which the web is supported by the porous belt and the metal belt.

A preferred embodiment of the present invention may be characterized by large compressive forces created perpendicular to a thickness of the web (and perpendicular to the outer circumference of the dryer cylinder) which may provide an efficient heat transfer or transport to the material web. Further, in accordance with the present invention, the heat transport within the material web may be significantly improved. Steam from the material web may be optimally guided to the dryer screen due to the high contact pressures and temperature differences. The temperature differences may be created to be as large as possible between the dryer screen and the dryer cylinder, thus, ensuring a large heat flow. To assist in creating the temperature differences, additional heating and cooling installations may be assigned to the cylinders and located to act on a portion of a circumferential area on which the web is supported by the dryer screen and metal belt. Thus, because the additional heating and cooling installations are located in a vicinity of the cylinders, a large heat flow may be ensured, particularly, in areas in which the high surface pressure occurs. The high surface pressure may be achieved by prestressing at least one of the metal belt and the dryer screen, which may result in a pressure of, e.g., approximately 10 kPa to 100 kPa, on the web.

Particularly preferred is an embodiment of the device of the present invention in which the metal belt may be directly supported by a heated dryer cylinder, while an outside positioned dryer screen may be cooled by a cooling device. Because the metal belt may transfer heat from the heated dryer cylinder efficiently to the material web, a large temperature drop within the material web may occur toward the cooled outside positioned dryer screen. The moisture in the material web may, thus, be transported intensely to the dryer screen, where it may be removed by the cooling device.

Further, an embodiment of the device of the present invention may be preferred in which a dryer cylinder may be provided with circulating grooves. The dryer screen supported by the dryer cylinder may, therefore, transfer moisture to the dryer cylinder in a particularly effectively manner.

In another particularly preferred embodiment of the present invention, a cylinder may be provided with circulating grooves and may be subjected to additional suction, e.g., from an external suction box. In an embodiment of this type, the moist air may be drawn away from the material web, which may result in a particularly effective manner of drying of the web.

The present invention may be directed to a device for manufacturing a material web in a dryer part that includes at least one dryer section having a plurality of cylinders including heated cylinders and cooled cylinders. The device may also include a porous dryer screen and a metal belt that may be guided with the material web in a meandering path alternatingly around the heated and cooled cylinders. At least one of the metal belt and the dryer screen being highly prestressed and the device may also include at least one of a heating installation and a cooling installation assigned to act on an area of a circumference of the plurality of cylinders, in which the material web may be supported by the dryer screen and the metal belt.

According to another feature of the present invention, the metal belt may be directly supported by the heated cylinders, the dryer screen may be directly supported by the cooled cylinders, and the metal belt may be heated in the area of the circumference of the cooled cylinders by the heating installation and the dryer screen is cooled in the area of the circumference of the heated cylinders.

According to another feature of the present invention, a surface of at least one of the plurality of cylinders may be provided with circulating grooves.

According to another feature of the present invention, at least one of the plurality of cylinders may be subjected to suction by an external suction box.

According to another feature of the present invention, the device further including a pressing unit located in a vicinity of one of the plurality of cylinders.

According to another feature of the present invention, the cooling installation may include one of a blow box, a suction box, or vacuum and blow box to dry the dryer screen.

According to another feature of the present invention, centers of the heated cylinders may be arranged in an imaginary plane and centers of the cooled cylinders may be arranged in a second imaginary plane which is spaced from the first plane by a predetermined distance.

According to another feature of the present invention, the dryer section may include at least a first dryer group and a second dryer group.

According to another feature of the present invention, centers of the heated cylinders of the first and second dryer group may be arranged in a first plane and centers of the cooled cylinders of the first and second group may be arranged in a second plane.

According to another feature of the present invention, centers of the heated cylinders of first dryer group may be arranged in a first plane and centers of the cooled cylinders of the first dryer group may be arranged in a second plane. Centers of the heated cylinders of the second dryer group may be arranged in a third plane and centers of the cooled cylinders may be arranged in a fourth plane. Further, heated cylinders of the first dryer group may be positioned one of above and below the cooled cylinders, and the heated and cooled cylinders of the second dryer group may be positioned opposite the first dryer group.

According to another feature of the present invention, centers of the heated cylinders may be arranged on a V-shaped line.

According to another feature of the present invention, the material web may be guided through the dryer section such that only of the top and bottom surface is heated.

According to another feature of the present invention, the material web may be guided through the dryer section such that only one of the top and bottom surface is cooled.

According to another feature of the present invention, the dryer section may include a plurality of dryer groups. When the material web is guided from one of the plurality of dryer groups to another, a top and bottom surface of the material web is alternatingly heated and cooled. Further, each of the plurality of dryer groups may include at least one of a separate dryer screen and a separate metal belt.

According to another feature of the present invention, the metal belt may be guided to always be supported by a surface of at least one heated cylinder.

According to another feature of the present invention, the dryer screen may be guided to always be supported in such a way that it is always supported by a surface at least one cooled cylinder.

According to another feature of the present invention, the prestressed at least one of the metal belt and dryer screen may exhibit a surface pressure of greater than or equal to approximately 2 kPa. Alternatively, the prestressed at least one of the metal belt and dryer screen may exhibit a surface pressure of greater than or equal to approximately 4 kPa Still further, the prestressed at least one of the metal belt and dryer screen may exhibit a surface pressure of between approximately preferably 10 kPa to 100 kPa.

According to another feature of the present invention, the cooled cylinders may include suction rolls subjected to at least one of external and internal suction.

The present invention may be directed to a dryer section for a material web producing machine. The dryer section may include a plurality of cylinders including heated cylinders and cooled cylinders, a dryer screen, and a metal belt. At least one of the metal belt and the dryer screen may exerting a predetermined force on the plurality of cylinders. The dryer section may also include at least one heating installation associated with the cooled cylinders and at least one cooling installation associated with the heated cylinders. The dryer screen and the metal belt may be alternatingly guided in a meandering path around the heated and cooled cylinders.

According to another feature of the present invention, the at least one heating installation may act on the metal belt.

According to another feature of the present invention, the at least one cooling installation may act on the dryer screen.

According to another feature of the present invention, outer surfaces of the heated cylinders may be positioned closer to metal belt than the dryer screen and outer surfaces of the cooled cylinders may be positioned closer to the dryer screen than the metal belt.

According to another feature of the present invention, a predetermined temperature difference may be maintained between the dryer screen and the metal belt.

According to another feature of the present invention, the dryer section may further include at least a first dryer group and a second dryer group.

According to another feature of the present invention, the first dryer group may be adapted to dry one side of the material web and the second dryer group may be adapted to dry the one side of the material web.

According to another feature of the present invention, centers of the heated cylinders of the first and second dryer group may be linearly arranged and parallel to centers of the cooled cylinders of the first and second dryer group.

According to another feature of the present invention, the first dryer group may be adapted to dry one side of the material web and the second dryer group may be adapted to dry an opposite side of the material web.

According to another feature of the present invention, centers of the heated cylinders of the first dryer group may be linearly arranged and parallel to centers of the cooled cylinders of the first dryer group, and the heated cylinders may be positioned one of above and below the cooled cylinders, and centers of the heated cylinders of the second dryer group may be linearly arranged and parallel to centers of the cooled cylinders of the second dryer group, and the heated cylinders may be positioned the other of above and below the cooled cylinder.

According to another feature of the present invention, the first dryer group may be arranged as an inverted mirror image of the second dryer group.

According to another feature of the present invention, the cooled cylinder may include a plurality of openings for communication with an external suctioning device.

According to another feature of the present invention, a press roll may be associated with the cooled cylinder for exerting a force on the metal belt toward the dryer screen.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

Figure 1:
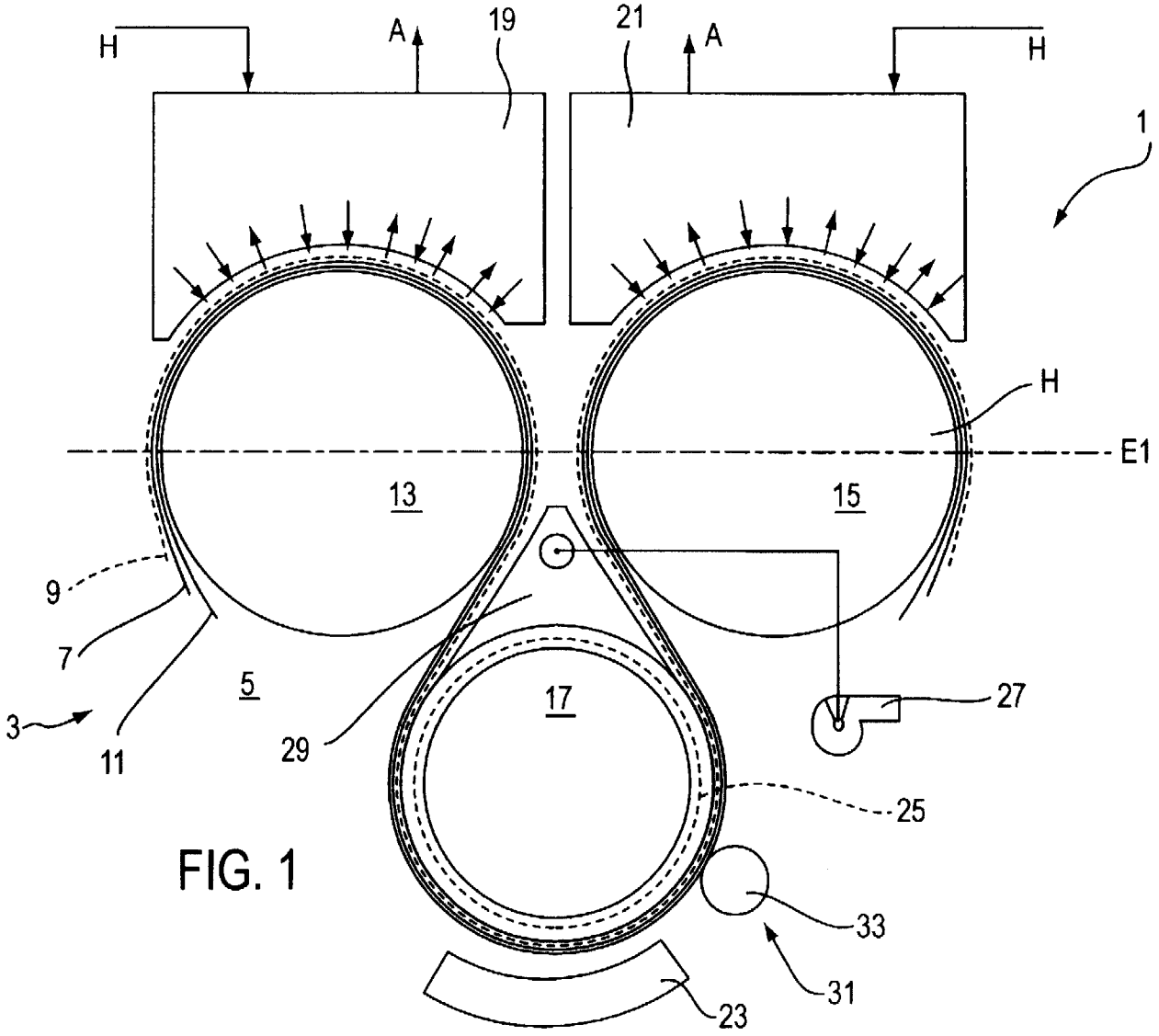
FIG. 1 illustrates a sectional side view of a dryer section in a device for manufacturing webs.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

The device described in the following disclosure may be generally utilized for manufacturing a material web. While the exemplary embodiment refers to paper or cardboard webs, this example is for the purpose of illustration only and is not intended as limiting.

FIG. 1 illustrates a sectional side view of a device for manufacturing or producing a material web, e.g. paper or cardboard, comprising a dryer section 3, which may contain at least one dryer group 5. Within dryer section 3, a plurality of cylinders may be provided. Material web 7 may be guided in a meandering or winding path, with a dryer screen 9, and a metal belt 11.

FIG. 1 illustrates two heated cylinders 13 and 15 arranged such that their centers may be positioned in a substantially same imaginary plane E1. Below plane E1, and substantially between heated cylinders 3 and 15, another cylinder 17, e.g., a cooled cylinder, may be arranged. Material web 7 may be guided between dryer screen 9 and the metal belt 11. As shown in FIG. 1, metal belt 11 may be positioned, with respect to material web 7, to be directly supported by heated cylinders 13 and 15, and dryer screen 9 may be positioned, with respect to metal belt 11 and material web 7, to be directly supported by a surface of cooled cylinder 17. Around cooled cylinder 17, metal belt 11 may be positioned at an outermost position away from the surface of the cooled cylinder 17.

Cooling installations 19 and 21, e.g., vacuum suction and blow boxes, may be arranged around a least a portion of a circumference of heated cylinders 13 and 15. Cooling installations 19 and 21 may be supplied with hot air to act on a surface of dryer screen 9 to absorb existing moisture. The moist outgoing air, as indicated by arrow A, may be suctioned out of the suction boxes utilized as cooling installations 19 and 21. Thus, because the moist air does not reach the environment, a cover for dryer section 3 may be relatively simply designed.

The specified temperature in cooling installations 19 and 21 may be within a range, e.g., from approximately 100° C. to 200° C., while a surface temperature of heated cylinders 13 and 15 may be within a range, e.g., from approximately 150° C. to 300° C. Heated cylinders 13 and 15 may be heated with, e.g., steam or hot gas. It is also important that the temperatures in heated cylinders 13 and 15 be higher than the temperature in the cooling installations 19 and 21. In this manner, a temperature drop from the surface of heated cylinders 13 and 15 through metal belt 11, and across material web 7 and dryer screen 9, may be adjusted. Thus, moisture may pass from material web 7, through dryer screen 9, and into cooling installations 19 and 21. Dryer screen 9 may be porous and may be made of, e.g., plastic or metal.

A diameter of heated dryer cylinders 13 and 15 may be, e.g., between approximately 1.5 m and 5.0 m, with an outside diameter of 2.2 m preferred. Cooled cylinder 17 may be provided with a radius smaller than the radius of heated cylinders 13 and 15, e.g., between approximately 1.0 m to 1.5 m. Steam or water may be supplied for adjustably cooling an outer surface of cooled cylinder 17 to, e.g., between approximately 90° C. to 120° C.

Metal belt 11 may be heated in a vicinity of a web and belt support area of cooling cylinder 17. A heating installation 23 may be utilized for heating metal belt 11 in the vicinity of the support area and may be positioned adjacent metal belt 11 along a portion of a circumference of cooling cylinder 17. This external heating of metal belt 11 may be effected, e.g., with hot gas, infrared energy, or electricity. According to the present invention, an adjustable and high temperature difference is to be maintained between metal belt 11 and dryer screen 9. To optimize the heat transport through material web 7, metal belt 11 is maintained at a temperature greater than dryer screen 9. Thus, the meandering path on which the belt, web, and screen are guided through dryer section 3 provides that when metal belt 11 is abutting a heating cylinder, e.g., cylinder 13, dryer screen 9 is positioned adjacent a cooling installation. Conversely, when dryer screen 9 abuts the dryer cylinder, e.g., cylinder 17, metal belt 11 may be adjacent a heating installation, thus, maintaining the desired temperature difference.

Due to the heat transfer from the metal belt 11 to the material web 7, steam may be generated within the paper material web. The generated steam may precipitate onto the cooler dryer screen 9. The precipitated steam, in the form of water, may be removed from material web 7 by the above-noted combination of heat and web transport processes.

To support the material web transport through dryer section 3, a surface of cooling cylinder 17 may be provided with grooves 25 arranged around the circumference to enable the entry of moisture into cooling cylinder 17. The removal of moisture may be particularly effective if vacuum source 27 and external suction box 29 are arranged adjacent cooling roll 17 and opposite the support area. Thus, the moisture at the support area may be drawn, i.e., suctioned, into cooling roll 17 through grooves 25 by external suction box 29 and vacuum source.

Dryer screen 9 and metal belt 11 may be prestressed, so that a dryer cylinder having, e.g., a 2.2 m outside diameter may produce a surface pressure of, e.g., between approximately 10 kPa to 100 kPa in the support area of heated cylinders 13 and 15. However, it is also contemplated that the surface pressure of dryer sections may also be greater than or equal to, e.g., approximately 2 kPa or 4 kPa.

As a result of the high pressure and the effect of the high temperature, paper material web 7 may have very high strength properties which may be due to a softening of the lignin and hemicellulose contained in material web, and to an increased number of fiber compound locations.

In order to also achieve higher contact pressure upon demand, a pressing unit 31 may be provided with a press roll 33, which interacts with the surface of cooling cylinder 17. Press roll 33 may press directly on metal belt 11, such that material web 7 and dryer screen 9, both being located beneath metal belt 11 around cooling cylinder 17, are considerably compressed.

Dryer screen 9, as it runs off the surface of cooling cylinder 17, may be relatively moist. That is, dryer screen 9 may absorb the moisture released by material web 7 in the area of cooling cylinder 17. Dryer screen 9 may be attacked or treated with hot air H from cooling installations 19 and 21 to remove the moisture and to allow dryer screen 9 to dry. At the same time, the moisture within cooling installations 19 and 21 may be removed from material web 7 by heating the bottom of material web 7 with exhaust air A. Utilizing, e.g., suction boxes for cooling installations 19 and 21, the drying effect is significantly improved in relation to prior art devices. It is also advantageous if the outgoing air, i.e., on the surface of dryer screen 9 or the moisture released from material web 7, is directly removed from the area in which the moisture is generated.

Due to the high contact pressure, an optimal heat transfer, i.e., from the heated to cooled surfaces, may occur on material web 7, which results in a very efficient heat flow. Further, material web 7 may be treated to additional heating/cooling processes in which web material 7 is alternately guided around heated and cooling cylinders, i.e., with respect to a web travel direction, to create a large temperature drop within material web 7. This large temperature drop may result in a high evaporative duty, so that dryer section 3 may be developed in a very compact fashion. In many cases, the number of cylinders utilized in the dryer section may be reduced in comparison to conventional facilities of the prior art.

Material web 7 may be firmly clamped between dryer screen 9 and metal belt 11 when passing through dryer group 5. FIGS. 2–5 show exemplary arrangements for a dryer section in accordance with the present invention. The clamping or mounting of material web 7 will prevent shrinkage so as to provide uniform properties across its width, thus, significantly improving material web quality.

Figure 2:
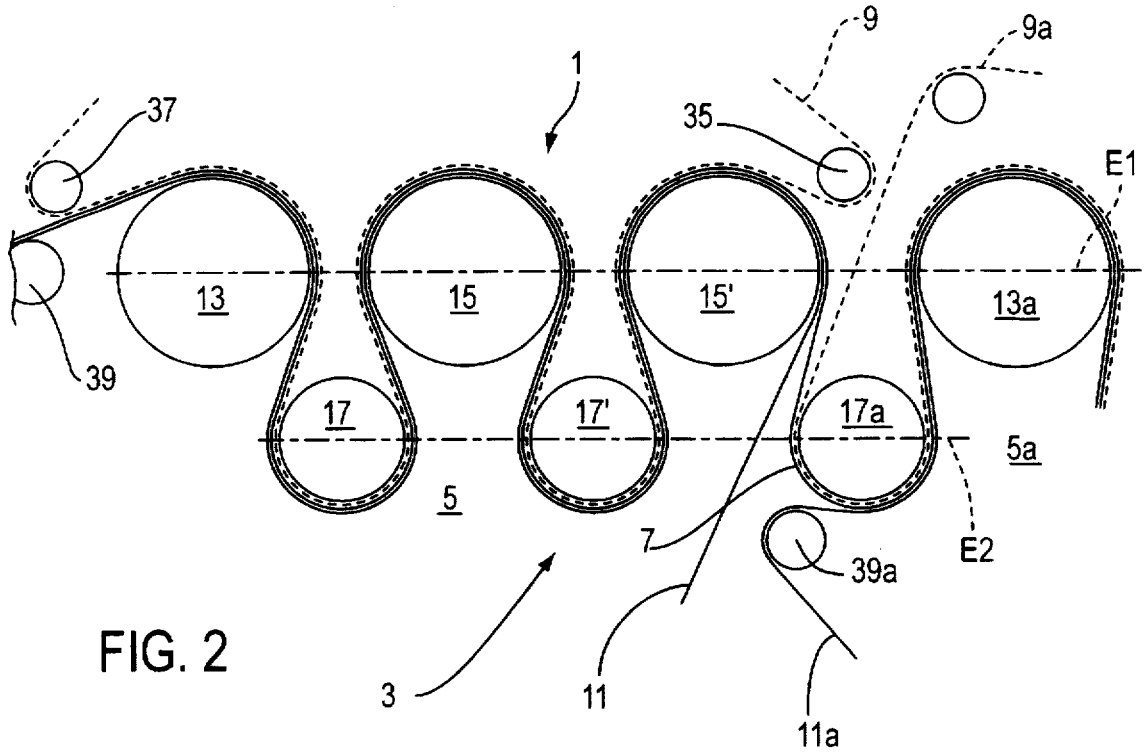
FIG. 2 illustrates two dryer sections and a transition area between the dryer sections for use with the device of the present invention.

Dryer section 3 may, as indicated in FIG. 1, include several dryer groups 5. FIG. 2 illustrates that one dryer group 5 may be connected to another dryer group **5*a***.

Further, in addition to heated cylinders 13 and 15, dryer group 5 may also include, e.g., a third heated cylinder 15' which may be connected with a heated cylinder **13*a* of second dryer group 5*a*, and in addition to cooling cylinder 17, first dryer group 5 may also include another cooling cylinder 17'. Dryer screen 9 may be fed from an end of the first dryer group 5 by a deflection roll 35 back to a beginning of first dryer group 5 to a deflection roll 37. Correspondingly, metal belt 11 may be returned to a beginning of first dryer group 5, for example, on a deflection roll 39**.

Dryer screen **9*a* may be guided past the outer circumferential surface of heated cylinder 15' to transfer material web 7, from atop metal belt 11 to atop a first cooling cylinder 17*a* of second dryer group 5*a*. Metal belt 11*a*, associated with second dryer group 5*a*, may be guided onto first cylinder 17*a* by a deflection roll 39*a*, so that material web 7 may be guided safely through second dryer group 5*a* between dryer screen 9*a* and metal belt 11*a***.

In the embodiment illustrated in FIG. 2, heated cylinders 13, 15, 15' and **13*a* may be located in a substantially same imaginary plane E1. Further, the centers of cooling cylinders 17 and 17*a*** may be arranged in a substantially same imaginary plane E2.

In material web producing machine 1, or dryer section 3, as material web 7 is guided through one dryer group and transferred to, and guided through, another dryer group, the bottom side or surface of material web 7 may be heated from the surface of heated cylinders 13, 15, 15', **13*a*. Further, as material web 7 is guided through dryer section 3, the top side or surface of material web 7 may be cooled by cooling cylinders, 17, 17', 17*a***.

As an alternative, to minimize the two-sided nature of material web 7, a reciprocal drying process may be utilized. This alternative may be shown, e.g., in FIG. 3, in which two adjacent dryer groups 5 and **5*a* of dryer section 3 are depicted. The transfer of material web 7 may occur such that material web 7 may be transferred from a last cylinder, e.g., a cooling cylinder 17" of first dryer group 5, to a first cylinder, e.g., cooling cylinder 17*a* of second dryer group 5*a*. From cooling cylinder 17", material web 7 may be positioned to be guided together with, and located between, metal belt 11*a* and dryer screen 9*a* to first heated dryer cylinder 13*a*. With respect to the support area of cooling roll 17", metal belt 11*a* may be positioned atop, and dryer screen 9*a* may be positioned below, material web 7. The centers of heated dryer cylinders of first dryer group 5 may be positioned within a plane E1, and the centers of cylinders 17, 17', and 17" may be positioned within a second plane E2. The centers of the heated cylinders 13*a* (and any additional heated cylinders to be utilized in this embodiment) of second dryer group 5*a*** may be positioned within a substantially same plane E1*a*, and the centers of cooling cylinders **17*a*** (and any additional cooling cylinders to be utilized in this embodiment) may be positioned within a substantially same imaginary plane E2*a*.

Figure 3:
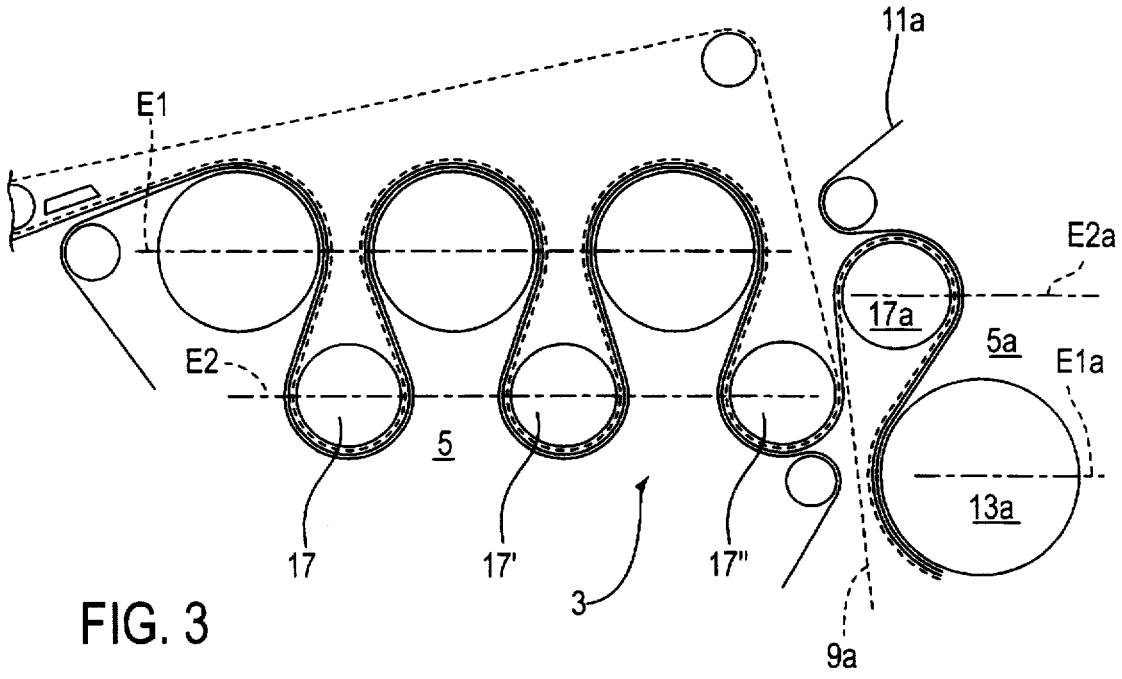
FIG. 3 illustrates an alternative embodiment of the transition area depicted in FIG. 2.

As shown in FIG. 3, plane E2*a* may be arranged below plane E1*a*, and the proportions in dryer group 5 may be reversed. Thus, the heated cylinders of first dryer group 5 may act on a first side of material web 7, and the heated cylinders of second dryer group **5*a* may act on a second (and opposite) side of material web 7**.

Figure 4:
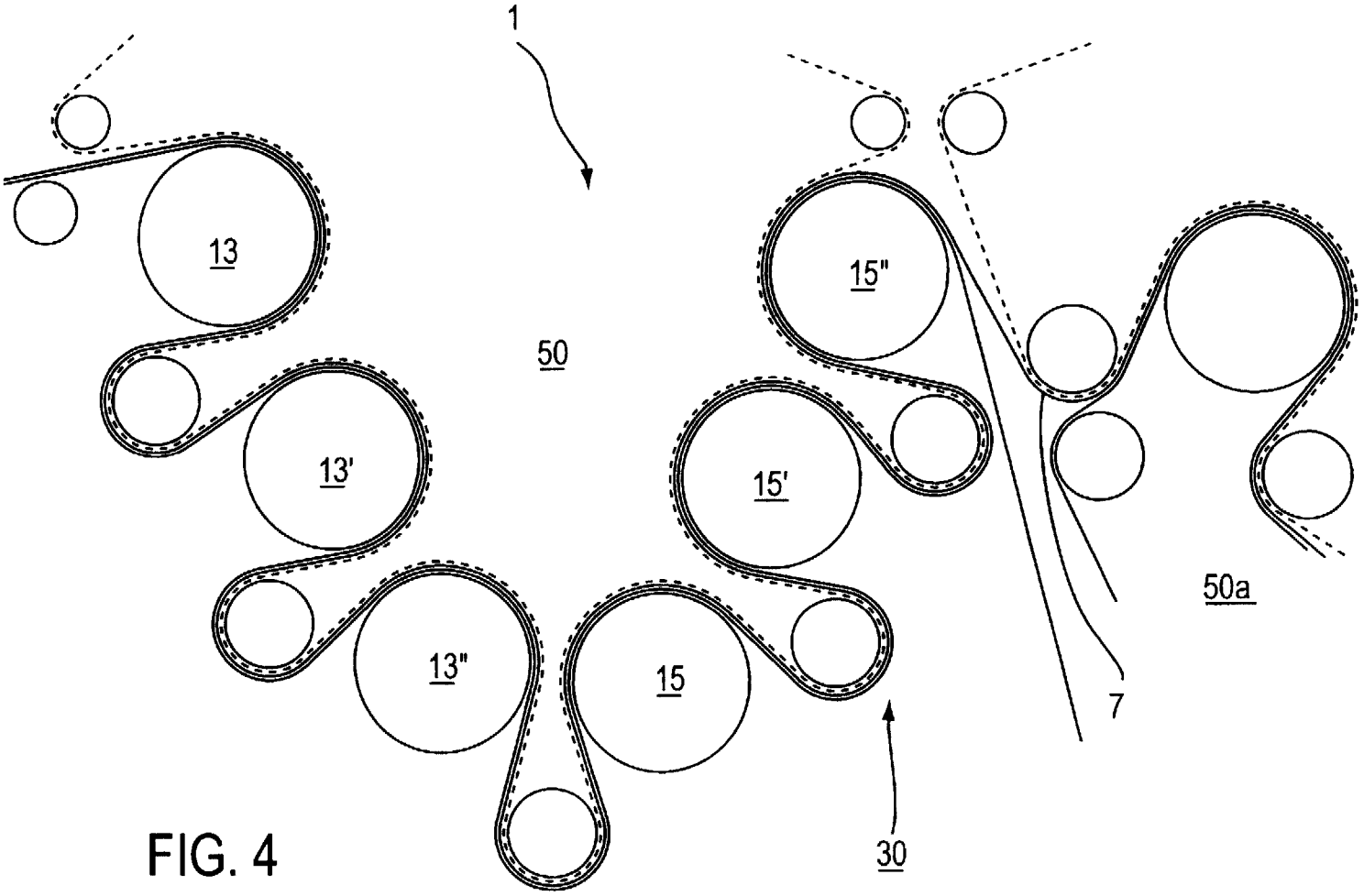
FIG. 4 illustrates another alternative embodiment of a dryer section with a transition to a subsequent dryer section.

FIG. 4 may illustrate another alternative embodiment of the present invention. For example, FIG. 4 shows a modified a dryer group 50, in which heated cylinders 13, 13', 13", 15, 15" may be arranged on an imaginary and substantially V-shaped line, and the cooling cylinders, disposed in a vicinity between adjacent heated cylinders, may also be arranged on a separate imaginary and substantially V-shaped path. A similar arrangement may be utilized for the heated and cooling cylinders of the subsequent dryer group **50*a*, of which only a first heated cylinder is shown. In the embodiment illustrated in FIG. 4, material web 7 of dryer section 30 of material web producing machine 1 may be transferred between dryer groups 50 and 50*a* such that its bottom side or surface of may be positioned toward the heated cylinders and its upper side may be positioned toward the cooling cylinders as the material web is guided through the dryer groups 50 and 50*a***.

However, in a manner corresponding to the discussion of the alternative embodiment of FIG. 3, dryer section 30, as illustrated in FIG. 4, may also be alternatively arranged so that reciprocal (i.e., double sided) drying of material web 7 may be ensured. In this alternative arrangement, material web 7 may be supported on its bottom side by the heated cylinders of first dryer group 50, and may be supported on its upper side by the heated cylinders of second dryer group 50*a*. It is noted that one ordinarily skilled in the art, by referring to FIG. 3 and the accompanying text, could correspondingly rearrange the embodiment depicted in FIG. 4 into an alternative reciprocal drying arrangement within the purview of the present invention.

Figure 5:
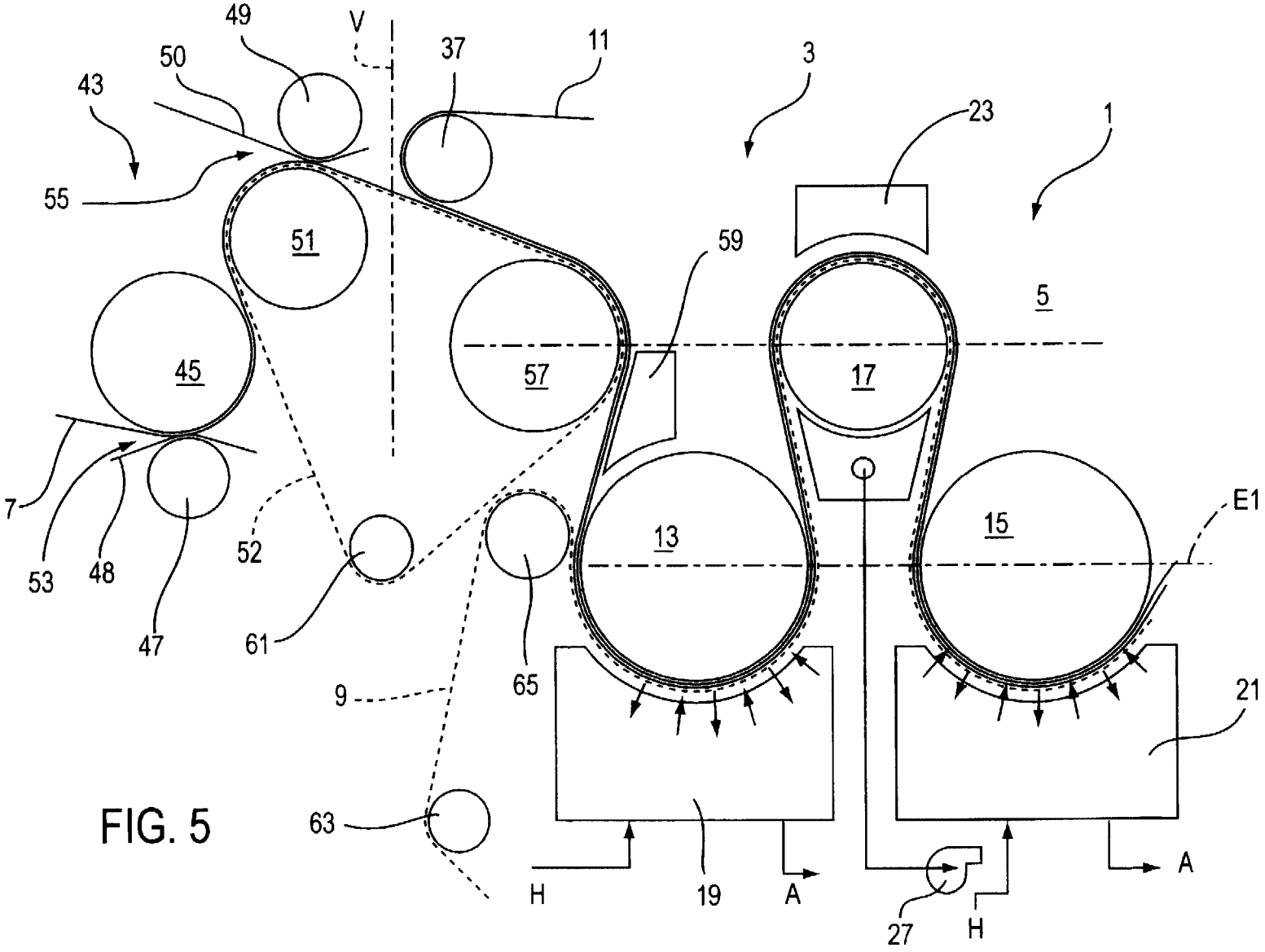
FIG. 5 illustrates the transition area of a pressing unit for the first dryer section of a dryer section.

FIG. 5 illustrates another dryer section 3 of material web producing machine 1, in which material web 7 may be transferred to first dryer group 5 of dryer section 3 from a pressing unit 43. First dryer group 5 may include components substantially similar to those depicted in FIG. 1. Those substantially similar components have been labeled to correspond with the components shown in FIG. 1.

Press section 43 may include a web guide roll 45 which, together with a press cylinder 47 and a drainage belt 48, forms a nip or gap for compressing and draining material web 7 as it is guided through the nip. Material web guide roll 45 may be followed, in a web travel direction, by a central roll 51 formed as another web guide roll. A drainage belt 50 and a press cylinder 49 may be associated with central roll 51 to form another nip or gap. A transfer belt or conveyor 52, which may be positioned to guide material web 7 from press section 43 to dryer section 3, may be guided around central roll 51. Further, central roll 51 may be the last material web guide roll of press section 43, i.e., dot-dash line V may delineate an end of press section 43 and a beginning of dryer section 3.

As noted above, material web 7 may be guided around material web guide roll 45 and may be compressed in nip 53. Fluid squeezed out of material web 7 may be taken up or removed by drainage belt 48. Thus, the compression of material web 7 in press nip 53 may intensify or accentuate any subsequent drying process. Material web 7 is transferred, via transport belt 52, from web guide roll 45 onto central roll 51. Material web 7 may be guided around central roll 51 and may be supported by an exterior surface of transport belt 52. Material web 7, still supported by transport belt 52, may be compressed and drained when guided through press nip 55. After passing through press nip 55 on transport belt 52, material web 7 may be guided past a deflection roll 37 of dryer group 5 that guides metal belt 11 which is also associated with dryer group 5. As shown, material web 7, in the vicinity of deflection roll 37, may be clamped between metal belt 11 and transport belt 52 to be guided around a web guide roll 57. Metal belt 11, material web 7, and transport belt 52 rotate around a portion of the outer periphery of web guide roll 57. However, metal belt 11 and material web 7 may lift off and separate from transport belt 52. Thus, metal belt 11 and material web 7 may be guided through dryer group 3 and transport belt 52 may be guided back to central roll 51 via a deflection roll 61. Metal belt 11 and material web 7 may be guided onto first dryer cylinder 13 of dryer group 5, while a web stabilizer 59, provided in a transition area between web guide roll 57 and dryer cylinder 13, may have an attractive effect on the porous metal belt and the material web. Web stabilizer 59, e.g., a suction box that may be coupled to a vacuum source, may prevent a fluttering of material web 7 within the transition area and may substantially eliminate material web tears. Metal belt 11 and material web 7 may be guided onto first dryer cylinder 13 with dryer screen 9. Dryer screen 9 may be fed onto first dryer cylinder 13 via a plurality of deflection rolls, of which only deflection rolls 63 and 65 are shown. Material web 7 may be clamped between dryer screen 9 and metal belt 11 as they are guided around a portion of the outer circumference of dryer cylinder 13. As discussed above, metal belt 11 may positioned adjacent to first dryer cylinder 13 with material web 7 and dryer screen 9 positioned on a side of metal belt 11 opposite the dryer cylinder. Further, as discussed above, metal belt 11, material web 7, and dryer screen 9 may be alternatingly guided around dryer cylinders associated with respective heating and cooling installations.

The transition of material web 7 from press section 43 to dryer section 3 via transport belt 52 offers the opportunity, e.g., in the event of a web tear, to guide a transport belt quickly and safely through web producing machine 1. Web producing machine 1, therefore, may have relatively short downtimes, which increases profitability.

Because of the high surface pressure and high temperature differences created by the special heating and cooling processes, a high drying output may be provided by the present invention which may produce material webs offering particularly high-strength properties. Further, because of good drying values, the overall construction of the dryer section may be developed to be relatively compact.

Moreover, the potential for web tears may be minimized due to the above-described guidance of the material web. Still further, because of the solid clamping of the material web between the metal belt and the dryer screen through the dryer section, shrinkage of the width of the material web may be substantially prevented. Thus, the present invention enables maintaining very uniform paper properties across the width of the material web.

In accordance with the above-noted features of the present invention, guiding the material web between the dryer screen and the metal belt advantageously enables automatic introduction of the material web, i.e., a narrow web, prior to running the web producing machine. Accordingly, the present invention may be highly suitable for tower or V-type configurations of dryer cylinders, as explained, e.g., in FIG. 4.

While passing through the dryer section, the material web may be located on top of the metal belt. As a result of this arrangement, direct contact of the material web and the surface of the dryer cylinder is avoided. Thus, the dangers associated with adhesion or sticking of the material web to the dryer cylinders is eliminated and a safe run of the material web through the dryer section is substantially ensured.

In view of the foregoing, dryer cylinders 17, 17", 17" and 17*a*, which may be direct contact with the dryer screen, may be designed, e.g., without cooling systems and be developed conventionally. It is also conceivable that these cylinders may be configured as rolls subjected to external and/or internal suction. Further, the surface pressure exerted on the surface of the dryer cylinder may be less than, e.g., approximately 10 kPa, and may be, e.g., greater than or equal to approximately 2 kPa or 4 kPa.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within is the scope of the appended claims.

What is claimed is:

1. A device for manufacturing a material web in a dryer part comprising:

at least one dryer section comprising a plurality of cylinders including heated cylinders and cooled cylinders;

a porous dryer screen;

a metal belt;

the porous dryer screen and the metal belt being guided with the material web in a meandering path alternatingly around the heated and cooled cylinders;

at least one of the metal belt and the dryer screen being highly prestressed; and at least one of a heating installation and a cooling installation assigned to act on an area of a circumference of the plurality of cylinders in which the material web is supported by the dryer screen and the metal belt.

2. The device according to claim 1, wherein the metal belt is supported directly by the heated cylinders, wherein the dryer screen is directly supported by the cooled cylinders, and wherein the metal belt is heated in the area of the circumference of the cooled cylinders by the heating installation and the dryer screen is cooled in the area of the circumference of the heated cylinders.

3. The device according to claim 1, wherein a surface of at least one of the plurality of cylinders is provided with circulating grooves.

4. The device according to claim 1, wherein at least one of the plurality of cylinders is subjected to suction by an external suction box.

5. The device according to claim 1, further comprising a pressing unit located in a vicinity of one of the plurality of cylinders.

6. The device according to claim 1, the cooling installation comprising one of a blow box, a suction box, or vacuum and blow box to dry the dryer screen.

7. The device according to claim 1, wherein centers of the heated cylinders are arranged in an imaginary plane and centers of the cooled cylinders are arranged in a second imaginary plane which is spaced from the first plane by a predetermined distance.

8. The device according to claim 1, the dryer section comprising at least a first dryer group and a second dryer group.

9. The device according to claim 8, wherein centers of the heated cylinders of the first and second dryer group are arranged in a first plane and centers of the cooled cylinders of the first and second group are arranged in a second plane.

10. The device according to claim 8, wherein centers of the heated cylinders of first dryer group are arranged in a first plane and centers of the cooled cylinders of the first dryer group are arranged in a second plane, wherein centers of the heated cylinders of the second dryer group are arranged in a third plane and centers of the cooled cylinders are arranged in a fourth plane.

11. The device according to claim 8, wherein heated cylinders of the first dryer group are positioned one of above and below the cooled cylinders, wherein the heated and cooled cylinders of the second dryer group are positioned opposite the first dryer group.

12. The device according to claim 1, wherein centers of the heated cylinders are arranged on a V-shaped line.

13. The device according to claim 1, wherein the material web is guided through the dryer section such that only of the top and bottom surface is heated.

14. The device according to claim 1, wherein the material web is guided through the dryer section such that only one of the top and bottom surface is cooled.

15. The device according to claim 1, the dryer section comprising a plurality of dryer groups, wherein when the material web is guided from one of the plurality of dryer groups to another, a top and bottom surface of the material web is alternatingly heated and cooled.

16. The device according to claim 15, each of the plurality of dryer groups comprising at least one of a separate dryer screen and a separate metal belt.

17. The device according to claim 1, wherein the metal belt is guided to always be supported by a surface of at least one heated cylinder.

18. The device according to claim 1, wherein the dryer screen is guided to always be supported in such a way that it is always supported by a surface at least one cooled cylinder.

19. The device according to claim 1, wherein the prestressed at least one of the metal belt and dryer screen exhibits a surface pressure of greater than or equal to approximately 2 kPa.

20. The device according to claim 1, wherein the prestressed at least one of the metal belt and dryer screen exhibits a surface pressure of greater than or equal to approximately 4 kPa.

21. The device according to claim 1, wherein the prestressed at least one of the metal belt and dryer screen exhibits a surface pressure of between approximately preferably 10 kPa to 100 kPa.

22. The device according to claim 1, the cooled cylinders comprising suction rolls subjected to at least one of external and internal suction.

23. A dryer section for a material web producing machine comprising:

a plurality of cylinders including heated cylinders and cooled cylinders;

a dryer screen;

a metal belt;

at least one of the metal belt and the dryer screen exerting a predetermined force on the plurality of cylinders;

at least one heating installation associated with the cooled cylinders; and at least one cooling installation associated with the heated cylinders, wherein the dryer screen and the metal belt are alternatingly guided in a meandering path around the heated and cooled cylinders.

24. The dryer section according to claim 23, the at least one heating installation acting on the metal belt.

25. The dryer section according to claim 23, the at least one cooling installation acting on the dryer screen.

26. The dryer section according to claim 23, wherein outer surfaces of the heated cylinders are positioned closer to metal belt than the dryer screen, and wherein outer surfaces of the cooled cylinders are positioned closer to the dryer screen than the metal belt.

27. The dryer section according to claim 23, wherein a predetermined temperature difference is maintained between the dryer screen and the metal belt.

28. The dryer section according to claim 23, further comprising at least a first dryer group and a second dryer group.

29. The dryer section according to claim 28, wherein the first dryer group is adapted to dry one side of the material web, and wherein the second dryer group is adapted to dry the one side of the material web.

30. The dryer section according to claim 29, wherein centers of the heated cylinders of the first and second dryer group are linearly arranged and parallel to centers of the cooled cylinders of the first and second dryer group.

31. The dryer section according to claim 28, wherein the first dryer group is adapted to dry one side of the material web, and wherein the second dryer group is adapted to dry an opposite side of the material web.

32. The dryer section according to claim 31, wherein centers of the heated cylinders of the first dryer group are linearly arranged and parallel to centers of the cooled cylinders of the first dryer group, and the heated cylinders are positioned one of above and below the cooled cylinders, and wherein centers of the heated cylinders of the second dryer group are linearly arranged and parallel to center of the cooled cylinders of the second dryer group, and the heated cylinders are positioned the other of above and below the cooled cylinder.

33. The dryer section according to claim 31, wherein the first dryer group is arranged as an inverted mirror image of the second dryer group.

34. The dryer section according to claim 23, the cooled cylinder comprising a plurality of openings for communication with an external suctioning device.

35. The dryer section according to claim 23, a press roll associated with the cooled cylinder for exerting a force on the metal belt toward the dryer screen.

* * * * *